US007565834B2

(12) United States Patent
Adnan et al.

(10) Patent No.: US 7,565,834 B2
(45) Date of Patent: Jul. 28, 2009

(54) METHODS AND SYSTEMS FOR INVESTIGATING DOWNHOLE CONDITIONS

(75) Inventors: Sarmad Adnan, Sugar Land, TX (US); Stephen Nigel Davies, Doha (QA); Jerome Maniere, Moscow (RU); Christopher Lenn, London (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 38 days.

(21) Appl. No.: 11/751,405

(22) Filed: May 21, 2007

(65) Prior Publication Data

US 2008/0289408 A1 Nov. 27, 2008

(51) Int. Cl.
*E21B 47/06* (2006.01)

(52) U.S. Cl. ..... 73/152.12

(58) Field of Classification Search ..... 73/152.12; 166/250.15

See application file for complete search history.

(56) References Cited

U.S. PATENT DOCUMENTS

| | | | | |
|---|---|---|---|---|
| 6,009,216 | A | 12/1999 | Pruett | 385/12 |
| 6,268,911 | B1 | 7/2001 | Tubel | 356/72 |
| 6,354,147 | B1 | 3/2002 | Gysling | 73/61.79 |
| 6,497,290 | B1 | 12/2002 | Misselbrook | 166/384 |
| 6,588,266 | B2 | 7/2003 | Tubel | 73/152.39 |
| 6,732,575 | B2 | 5/2004 | Gysling | 73/61.79 |
| 6,862,920 | B2 | 3/2005 | Gysling | 73/61.79 |
| 6,988,411 | B2 | 1/2006 | Gysling | 73/645 |
| 6,997,256 | B2 | 2/2006 | Williams | 166/250.03 |
| 7,021,388 | B2 * | 4/2006 | Williams | 166/372 |
| 7,187,620 | B2 | 3/2007 | Nutt | 367/25 |
| 7,208,855 | B1 | 4/2007 | Floyd | 310/71 |
| 7,222,676 | B2 | 5/2007 | Patel | 166/378 |
| 2006/0196660 | A1 * | 9/2006 | Patel | 166/250.15 |
| 2008/0041594 | A1 * | 2/2008 | Boles et al. | 166/305.1 |
| 2008/0084913 | A1 * | 4/2008 | Perales et al. | 374/131 |

* cited by examiner

*Primary Examiner*—Hezron Williams
*Assistant Examiner*—Tamiko D Bellamy
(74) *Attorney, Agent, or Firm*—Rodney Warfford; David Cate; Robin Nava

(57) ABSTRACT

Methods and systems for investigating downhole conditions are described. One method comprises inserting a tubular into a wellbore, the tubular comprising a tubular section having upper and lower fluid injection ports, and having a thermally insulated fiber optic cable section positioned inside the tubular extending to the upper fluid injection port, and a non-insulated fiber optic cable section positioned outside of the tubular section and extending at least between the upper and lower fluid injection ports; positioning the tubular section having upper and lower fluid injection ports near a suspected thief or pay zone; injecting a fluid through the upper fluid injection port; determining a first differential temperature profile between the upper and lower fluid injection ports; injecting a fluid through the lower fluid injection port; and determining a second differential temperature profile at least between the upper and lower fluid injection ports.

20 Claims, 4 Drawing Sheets

METHODS AND SYSTEMS FOR INVESTIGATING DOWNHOLE CONDITIONS

BACKGROUND OF THE INVENTION

1. Field of Invention

The present invention relates generally to downhole oilfield tools and methods of use, and more specifically to downhole oilfield tools having two or more fluid injection ports for logging pressure, temperature, and/or fluid flow.

2. Related Art

It may be appreciated that well stimulation processes and systems have been in use for years. Typically, stimulation diversion processes and systems are comprised of downhole production logging tools (PLT), radioactive tracers with gamma ray detection tools and fiber optic strings measuring distributed temperature. These measurements in the PLT usually have single pressure, single flow meter, gamma ray and temperature. The data from these downhole tools are realtime when an electric cable and/or fiber optic fiber is connected inside the coiled tubing string, or in memory mode when the data is collected after the job.

Acidizing stimulation with coiled tubing may be effective if the acid can be placed in the correct targeted zones in the formation. The first step in accomplishing this is to determine the zone that would normally take the acid. Unfortunately, there is no current method of calculating this a priori or measuring placement during the job, and it is not possible to carry out production logging to measure the injectivity while pumping acid as the reactive fluid will continuously alter the injection conditions and profile. Other methods such as differential temperature sensing (DTS) to determine the well profile while pumping cold fluid are possible but have their own drawbacks.

From the above it is evident that there is a need in the art for improvement in monitoring oilfield fluid diversion systems and methods. In particular, it would be an advance in the art if downhole methods and systems could be devised wherein the tools and/or coiled tubing and DTS sensors are kept stationary the fluid injection point is changed to obtain two or more distinct logs. Alternatively, it would be advantageous if the fluid injection point is moved while point pressure is detected. With the help of these multiple logs, determination of the location of a thief zone would be feasible.

SUMMARY OF THE INVENTION

In accordance with the present invention, systems (also referred to herein as tools or downhole tools) and methods are described that reduce or overcome problems in previously known methods and systems for investigating and/or logging downhole conditions.

A first aspect of the invention is a method, one method of the invention comprising:

(a) inserting a tubular into a wellbore of a formation, the tubular comprising a tubular section having an upper and a lower fluid injection port, the tubular having a thermally insulated fiber optic cable section positioned inside the tubular extending to the upper fluid injection port, and a non-insulated fiber optic cable section positioned outside of the tubular section and extending at least between the upper and lower fluid injection ports for better thermal contact with formation fluids;

(b) positioning the tubular section having upper and lower fluid injection ports near a suspected thief or pay zone section of a formation;

(c) injecting a fluid through the upper fluid injection port;

(d) determining a first differential temperature profile along the tubular between the upper and lower fluid injection ports using the fiber optic cable;

(e) injecting a fluid through the lower fluid injection port; and (f) determining a second differential temperature profile along the tubular at least between the upper and lower fluid injection ports using the fiber optic cable.

Methods within the invention include those wherein fluid flow through the upper and lower injection ports may be hydraulically selected and actuated by simply varying the flow rate of injected fluid in the coiled tubing above or below a certain threshold value. In these methods the hydraulic selection could be performed at the surface by an operator. In certain methods of the invention, in order to increase the depth resolution of the temperature profile, the non-thermally insulated optical fiber cable section running outside the tool may be helically wound on the outside surface of the tubular. In yet other methods within the invention, in order to increase the temperature resolution of the temperature profile the non-thermally-insulated optical fiber section may be used in a double ended manner. The thermally insulated optical fiber section may be thermally insulated from the fluid in the tubular using a double wall flow path within the tube or by using other thermal insulators. In certain methods of the invention the differential temperature profiles may be obtained in real time, although the invention is not so limited. The first differential temperature profile may indicate a sharp temperature gradient at the top of a thief zone, while the second differential temperature profile may indicate a sharp temperature gradient at the bottom of a thief zone. Optionally, point pressure may be measured near or at the terminus of the tubular. Also, some embodiments of the invention may be used to obtain time-lapsed injectivity profiles useful for acting upon during treatment, or even for evaluation so the method may provide injectivity variation on a zone while treating with acid.

Another set of methods of the invention comprises:

(a) running a tubular into a wellbore of a formation, the tubular comprising a tubular section having an upper and a lower fluid injection port, the tubular having a thermally insulated fiber optic cable section positioned inside the tubular extending to the upper fluid injection port, and a non-insulated fiber optic cable section positioned outside of the tubular section and extending at least from the upper to the lower fluid injection port for better thermal contact with formation fluids;

(b) restricting fluid flow through an annulus between the tubular and the wellbore, at a location between the upper and lower fluid injection ports, during the running;

(c) flowing a fluid through the tubular and out of at least one of the fluid injection ports while running; and (b) measuring a point pressure at one or more positions along the tubular extending from the upper fluid injection port to a bottom end of the tubular while running the tubular into the wellbore.

Methods within this set of methods include flowing a fluid through the tubular and through the lower fluid injection port, and detecting a sudden pressure increase at the end of the tubular. A fixed packer or cup packer may be employed for restricting flow through the annulus. This sudden increase in point pressure at the end of the tubular would indicate that the packer had just passed a thief zone. Similar logging runs may provide additional useful information, for example: flowing a fluid through the tubular and through the upper fluid injection port, and sensing point pressure near the upper fluid injection port; flowing a fluid through the tubular and through the upper fluid injection port while sensing point pressure near the bottom of the tubular; flowing a fluid through the tubular and through the lower fluid injection port while sensing point pressure near the upper fluid injection port; and flowing a fluid through either or both fluid injection ports while sensing point pressure at both the upper and the lower fluid injection ports.

In optional embodiments, the fiber optic cable may be positioned through the internal cross section of the tubular, or though a tool attached to the end of the tubular. In these embodiments, flow would initially be injected through the upper fluid injection port and the temperature distribution along the tool would be measured in a standard DTS mode. In this way at least the initial flow of the injected fluid could be monitored.

The flow rate, volume, and temperature of injected fluid may vary over wide margins. Those skilled in the art will easily be able to determine the flow rates and temperatures required of the injected fluid to accomplish the intended purpose or purposes. Suggested ranges of these parameters are provided herein.

Another aspect of the invention are systems, one system comprising:

(a) a tubular able to extend from a surface station to a region to be logged in a wellbore, the tubular comprising a main flow passage and upper and lower fluid injection ports separated by a distance of the tubular sufficient to place an annulus flow restriction device between the fluid injection ports;

(b) the tubular having a thermally insulated fiber optic cable section positioned inside the tubular and extending from the surface to the upper fluid injection port, and a non-insulated fiber optic cable section optically connected to the insulated fiber optic cable positioned outside of the tubular section and extending at least between the upper and lower fluid injection ports for better thermal contact with formation fluids; and (c) a annulus flow restriction device positioned between the upper and lower fluid injection ports.

Systems within the invention may comprise one or more point pressure sensors, and may comprise other sensors for measuring other parameters, and means for using the measured parameters in realtime to monitor, control, or both monitor and control diversion of a fluid. Systems of the invention may include those wherein the sensors may be selected from flow meter spinners, electromagnetic flow meters, thermally active temperature sensors, thermally passive temperature sensors, pH sensors, resistivity sensors, optical fluid sensors and radioactive and/or non-radioactive tracer sensors, such as DNA or dye sensors. Systems of the invention may include means for using this information in realtime to evaluate and change, if necessary, one or more parameters of the fluid diversion. Means for using the information sensed may comprise command and control sub-systems located at the surface, at the tool, or both. Systems of the invention may include downhole flow control devices and/or means for changing injection hydraulics in both the annulus and tubing injection ports at the surface. Systems of the invention may comprise a plurality of sensors capable of detecting thief zones and/or pay zones, fluid flow out of the tubular, fluid flow below the tubular and up or down the annulus between the tubular and the wellbore in realtime mode that may have programmable action both downhole and at the surface. This may be accomplished using one or more algorithms allow quick realtime interpretation of the downhole data, allowing changes to be made at surface or downhole for effective treatment. Systems of the invention may comprise a controller for controlling fluid direction and/or shut off of flow from the surface. Exemplary systems of the invention may include fluid handling sub-systems able to improve fluid diversion through command and control mechanisms. These sub-systems may allow controlled fluid mixing, or controlled changing of fluid properties. Systems of the invention may comprise one or more downhole fluid flow control devices that may be employed to place a fluid in a prescribed location in the wellbore, change injection hydraulics in the annulus and/or tubular from the surface, and/or isolate a portion of the wellbore.

The inventive systems may further include different combinations of sensors/measurements above and below, (and may also be at) the injection port in the tubular to determine/verify diversion of the fluid, and location of thief zones and/or pay zones.

Systems and methods of the invention may include surface/tool communication through one or more communication links, including but not limited to hard wire, optical fiber, radio, or microwave transmission. In exemplary embodiments, the sensor measurements, realtime data acquisition, interpretation software and command/control algorithms may be employed to detect thief zones and/or pay zones, for example, command and control may be performed via preprogrammed algorithms with just a signal sent to the surface that the command and control has taken place, the control performed via controlling placement of the injection fluid into the reservoir and wellbore. In other exemplary embodiments, the ability to make qualitative measurements that may be interpreted realtime during a pumping service on coiled tubing or jointed pipe is an advantage. Systems and methods of the invention may include realtime indication of fluid movement (diversion) out one or more fluid injection ports, or out the downhole end of the tubular, which may include down the completion, up the annulus, and in the reservoir. Two or more flow meters, for example electromagnetic flow meters, or thermally active sensors that are spaced apart from the point of injection at the end of the tubular may be employed. Other inventive methods and systems may comprise two identical diversion measurements spaced apart from each other and enough distance above the fluid injection port at the end or above the measurement devices, to measure the difference in the flow each sensor measures as compared to the known flow through the inside of the tubular (as measured at the surface).

The inventive methods and systems may employ multiple sensors that are strategically positioned and take multiple measurements, and may be adapted for flow measurement in coiled tubing, drill pipe, or any other oilfield tubular. Systems of the invention may be either moving or stationary while the operation is ongoing. Treatment fluids, which may be liquid or gaseous, or combination thereof, and/or combinations of fluids and solids (for example slurries) may be used in stimulation methods, methods to provide conformance, methods to isolate a reservoir for enhanced production or isolation (non-production), or combination of these methods. Data gathered may either be used in a "program" mode downhole; alternatively, or in addition, surface data acquisition may be used to make real time "action" decisions for the operator to act on by means of surface and downhole parameter control. Fiber optic telemetry may be used to relay information such as, but not limited to, pressure, temperature, casing collar location (CCL), and other information uphole.

The inventive methods and systems may be employed in any type of geologic formation, for example, but not limited to, reservoirs in carbonate and sandstone formations, and may be used to optimize the placement of treatment fluids, for example, to maximize wellbore coverage and diversion from high perm and water/gas zones, to maximize their injection rate (such as to optimize Damkohler numbers and fluid residence times in each layer), and their compatibility (such as ensuring correct sequence and optimal composition of fluids in each layer).

Methods and systems of the invention will become more apparent upon review of the brief description of the drawings, the detailed description of the invention, and the claims that follow.

BRIEF DESCRIPTION OF THE DRAWINGS

The manner in which the objectives of the invention and other desirable characteristics may be obtained is explained in the following description and attached drawings in which.

Figure 1:
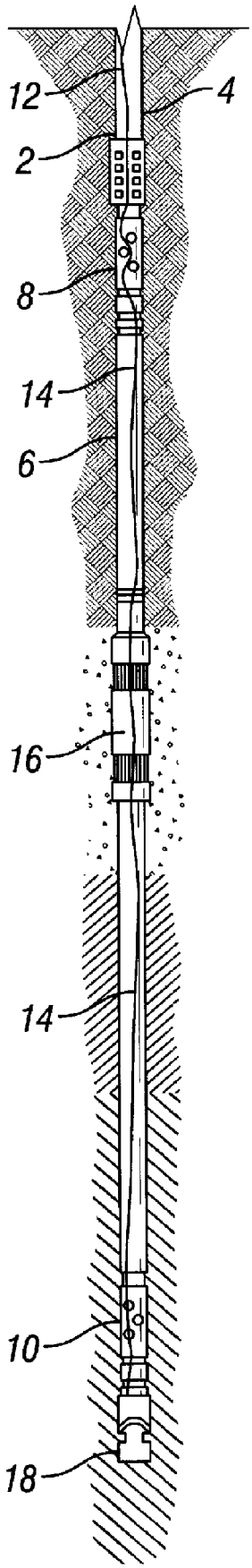
FIG. 1 is a schematic side cross-sectional view of a system in accordance with the invention.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

As used herein "oilfield" is a generic term including any hydrocarbon-bearing geologic formation, or formation thought to include hydrocarbons, including onshore and offshore. As used herein when discussing fluid flow, the terms "divert", "diverting", and "diversion" mean changing the direction, the location, the magnitude or all of these of all or a portion of a flowing fluid. A "wellbore" may be any type of well, including, but not limited to, a producing well, a non-producing well, an experimental well, and exploratory well, and the like. Wellbores may be vertical, horizontal, some angle between vertical and horizontal, and combinations thereof, for example a vertical well with a non-vertical component.

As mentioned previously, acidizing stimulation with coiled tubing and other tubulars may be effective if the acid can be placed in the correct targeted zones in the formation. The first step in accomplishing this is to determine the zone that would normally take the acid. Unfortunately, there is no current method of calculating this a priori or measuring placement during the job, and it is not possible to carry out production logging to measure the injectivity while pumping acid as the reactive fluid will continuously alter the injection conditions and profile. Other methods such as differential temperature sensing (DTS) to determine the well profile while pumping cold fluid are possible but have their own drawbacks.

The present invention describes methods and systems for more accurately evaluating such regions in an underground geologic formation. One embodiment is illustrated schematically in cross-section in FIG. 1. As illustrated in FIG. 1, a wellbore 2 is accessed by inserting a tubular 4 into the wellbore, tubular 4 comprising a tubular section 6 having an upper 8 and a lower 10 fluid injection port. Tubular 4, which may comprise coiled tubing, flanged pipe, welded pipe, or similar, comprises a thermally insulated fiber optic cable 12 section positioned inside the tubular. Thermally insulated fiber optic cable 12 extends to upper fluid injection port 8. A non-insulated fiber optic cable section 14 of the same fiber optic cable is positioned outside of tubular section 6 and extends at least between upper fluid injection port 8 and lower fluid injection port 10. This configuration allows for good thermal contact with formation fluids. Alternatively, non-insulated fiber optic cable section 14 may be helically wound onto the outside of tubular section 6 to increase the depth resolution of the temperature profile measured by the non-insulated section 14. Yet another alternative would be for the non-insulated section of fiber optic cable 14 to be formed in a double ended manner, with a plurality of switchbacks.

In one method embodiment, tubular section 6 and its accompanying fiber optic cable is positioned in the formation so that tubular section 6 having upper 8 and lower 10 fluid injection ports is near a suspected thief or pay zone section of a formation. A fluid having a temperature different than that of the formation is then injected through upper fluid injection port 8. A first differential temperature profile along the tubular section 6 between the upper 8 and lower 10 fluid injection ports is determined using non-insulated fiber optic cable 14. Subsequently, a fluid having a temperature different than that of the formation is injected through lower fluid injection port 10, and a second differential temperature profile along the tubular at least between upper 8 and lower 10 fluid injection ports is determined using non-insulated fiber optic cable 14.

In reference to FIG. 1, systems within the invention may selectively direct flow toward upper injection port 8 or lower injection port 10 with or without electronic actuators, for example based on spring-loaded pressure relief valves. Selection does not even have to be fully sealed. The distance between lower and upper injection ports is not particularly critical, but may, in some embodiments, range from 3 meters to 60 meters, and may range from 10 meters to 40 meters. Section 6 of tubular may either be a continuation of the main tubular 4, or may be a separate tool affixed to an end of tubular 4.

One or more point pressure measurement sensors 18 may be present in certain embodiments. In the embodiment illustrated in FIG. 1, point pressure measurement 18 is located at the distal end of tubular section 6. Point pressure measurement sensors may also be located near fluid injection ports 8 and/or 10, for example.

An optional packer or flow diverter 16 may be added between the upper and lower fluid injection ports 8, 10, the purpose being to simply cause a pressure drop in the annulus to allow for the detection of a thief or pay zone.

In operation of one method of the invention, the idea is to pump a fluid first through the upper fluid injection port 3, log the temperature data, and optionally other data such as point pressure, flow rate, and the like, and then pump the same or different fluid through the bottom port 10 and again log the data. Cross analysis of the two temperature plots should yield information about the location of a thief or pay zone.

In another method embodiment, fluid is pumped alternately through both fluid injection ports 8, 10, as described in the previous paragraph, but while moving the tubular 4 and tubular section 6 up and down past the suspected location of a thief or pay zone. A sharp pressure contrast may be seen when the packer 16 passes the pay/thief zones. Methods within this embodiment include flowing a fluid through tubular 4, tubular section 6, and through the lower fluid injection port 10, and detecting a sudden pressure increase at the distal end of tubular section 6 using a point pressure sensor 18. A fixed packer or cup packer 16 may be employed for restricting flow through the annulus. This sudden increase in point pressure at the distal end of tubular section 6 would indicate that packer 16 had just passed a thief zone. Similar logging runs may provide additional useful information, for example: flowing a fluid through tubular 4 and through upper fluid injection port 8, and sensing point pressure near upper fluid injection port 8; flowing a fluid through tubular 4 and through upper fluid injection port 8 while sensing point pressure near the distal end of tubular section 6 using a point pressure sensor 18; flowing a fluid through tubular 4 and through lower fluid injection port 10 while sensing point pressure near upper fluid injection port 8; and flowing a fluid through either or both fluid injection ports 8, 10 while sensing point pressure at both the upper and the lower fluid injection ports 8, 10.

In optional embodiments, the fiber optic cable may be positioned through the internal cross section of the tubular, or though a tool attached to the end of the tubular. In these embodiments, flow would initially be injected through the upper fluid injection port and the temperature distribution along the tool would be measured in a standard DTS mode. In this way at least the initial flow of the injected fluid could be monitored.

As mentioned previously, the flow rate, volume, and temperature of injected fluid may vary over wide margins, and those skilled in the art will easily be able to determine the flow rates and temperatures required of the injected fluid to accomplish the intended purpose or purposes. In methods of the invention, the temperature difference between the fluid being injected and the local formation be at least 10° C., and may be at least 50° C. In certain embodiments, for example in arctic regions, the injected fluid may be warmer than the formation, while in other methods within the invention the injected fluids may be colder than the local formation. The flow rate of injected fluid may be tailored to the specific task at hand, and may range from about 100 bbls/day up to about 10,000 bbls/day [16 to 1600 $m^3$/day].

Figure 2:
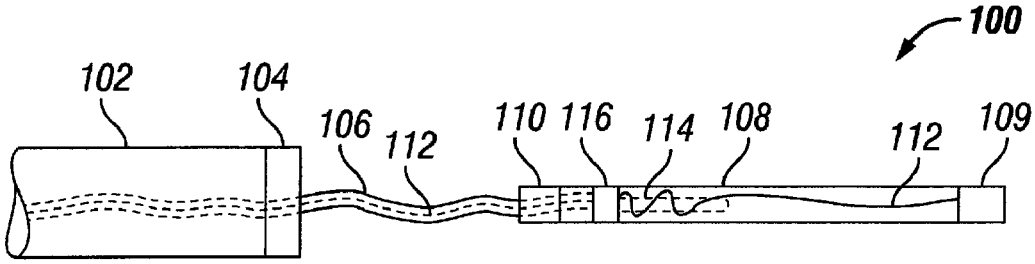
FIGS. 2-6 illustrate fiber optic termination apparatus useful in carrying out the methods of the invention.

Fiber optic tethers useful in the invention are now described. FIG. 2, illustrates schematically and not to scale a cross-sectional view of an apparatus 100 useful in the invention. FIG. 2 illustrates an oilfield tubular 102 which may be a piece of coiled tubing, section of pipe, and the like, having an end connection 104. An optical fiber carrier conduit or tube 106, which may be straight or flexible as illustrated, routes one or more optical fibers 112 through oilfield tubular 102. Apparatus 100 includes a body 108 that has a diameter smaller than the internal diameter of oilfield tubular 102. Body 108 has a first end 109 which is an optical fiber termination end, and a second end 110, which sealingly connects body 108 to optical fiber carrier 106. Optical fiber 112 may have slack, which may be wound around a fiber optic termination support rod 114 for a portion of its length. Body 108 also may comprise a bare fiber optic bulkhead 116 which functions to seal off fiber carrier 106 from wellbore fluids and treatment fluids. Apparatus 100 may thus be used to terminate a fiber carrier 106 in an oilfield tubular, and fiber optics 112 contained inside fiber carrier 106. Fiber carrier 106 may be mechanically held and sealed by a compression style fitting at end 110. Apparatus 100 may be described in certain embodiments as a cartridge that holds and protects fiber optic terminations made in the yard or on location.

Figure 3:
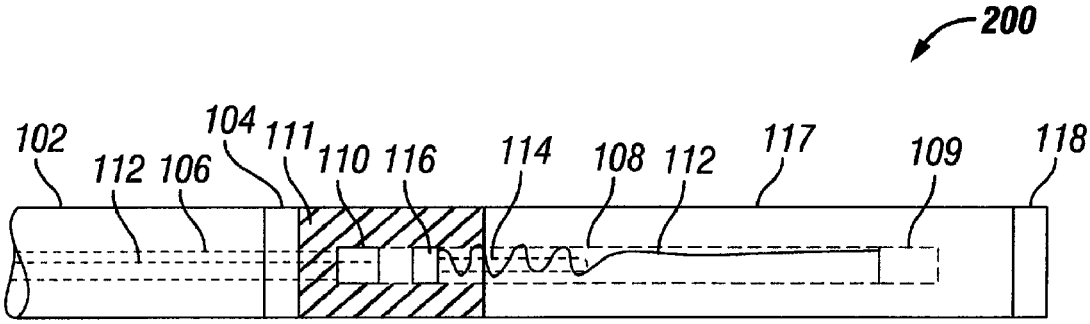
Figure 4:
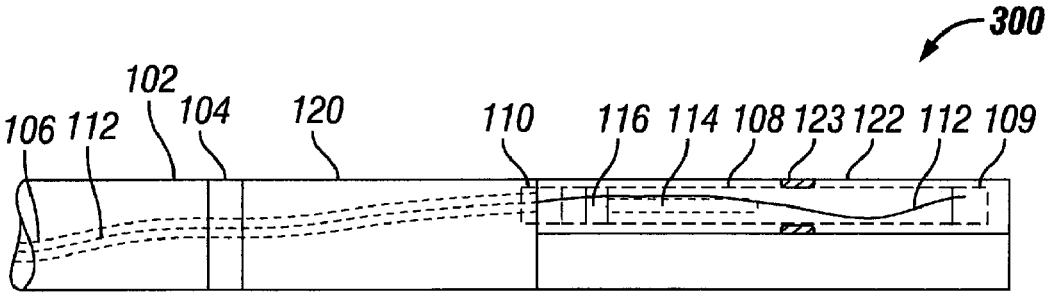

Referring now to FIGS. 3 and 4, embodiment 200 includes the same features as embodiment 100 of FIG. 2 with the addition of a stabbing head 117 having an end 118. The same numerals are used throughout the drawing figures for the same parts unless otherwise indicated. Stabbing head 117 is employed to hold body 108 while oilfield tubular 102 is being stabbed and un-stabbed from a coiled tubing injector head (not shown) or other equipment, such as a lubricator, blowout preventer, wellhead, and the like. Stabbing head end 118 may have a feature allowing embodiment 200 to be pulled through or removed from such equipment. In the case of coiled tubing, once the coiled tubing is installed in the injector, stabbing head 117 may be removed and a fiber optic-enabled coiled tubing head 122 may be installed (as seen in embodiment 300 of FIG. 4). Coiled tubing head 122 is designed to hold body or cartridge 108 and fiber optic terminations 109 in an environmentally sealed chamber, while also providing a fluid flow path 124. A connector 120 may be provided between oilfield tubular 102 and coiled tubing head 122 to provide an off center connection for end 110 of body 108. Body 108 may also be steadied by a stabilizer 123.

Figure 5:
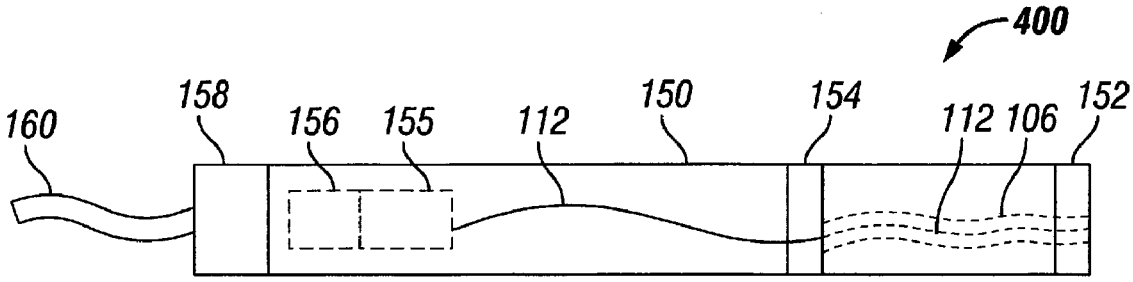

The bare fiber optic bulkhead 116 is an important aspect of the cartridge design and may be utilized for a variety of purposes. A specially machined plug or mechanical part can be used to pass bare fiber through as a bulkhead and maintain pressure integrity. The plug or part allows the user to minimize fiber optic terminations by allowing the bare fiber to pass through the bulkhead rather than having to make a fiber optic termination to get the fiber through the bulkhead. The reduction in fiber optic terminations reduces the loss of the system and is very important when the fiber becomes very long. A bare fiber optic bulkhead may also be employed in a pressure bulkhead. A bare fiber optic bulkhead could be applied with any pressure application being a possibility both on surface and down hole. A generic pressure bulkhead is described in reference to embodiment 400 of FIG. 5, which includes a body 150 having a connection 152 to an oilfield tubular (not shown). Another connection 154 secures fiber optic 112 and allows it to pass through body 150 to a fiber optic termination 155, which is in turn connected to an electrical or optical connection 156. Connection 156 may be a component of a surface electronics connection 158 having a lead or leads in a cable 160.

In a fiber optic-enabled coiled tubing string a fiber carrier protective tube 106 may carry any number of fibers, with the current standard being 4 fibers. The fibers may be color coded for easy identification on either end of the coiled tubing string, which can range from 2,000 to over 30,000 ft in length [610 to over 9100 meters]. In some embodiments each fiber may have a dedicated purpose, which makes it desirable to have the color coding to know where the fiber needs to be connected on the surface end and on the downhole end.

Figure 6A:
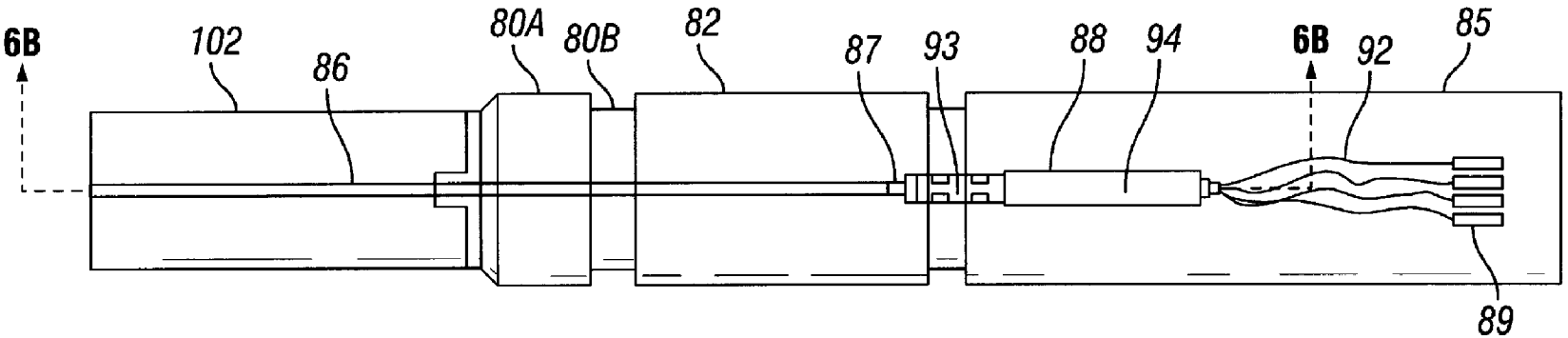
Figure 6B:
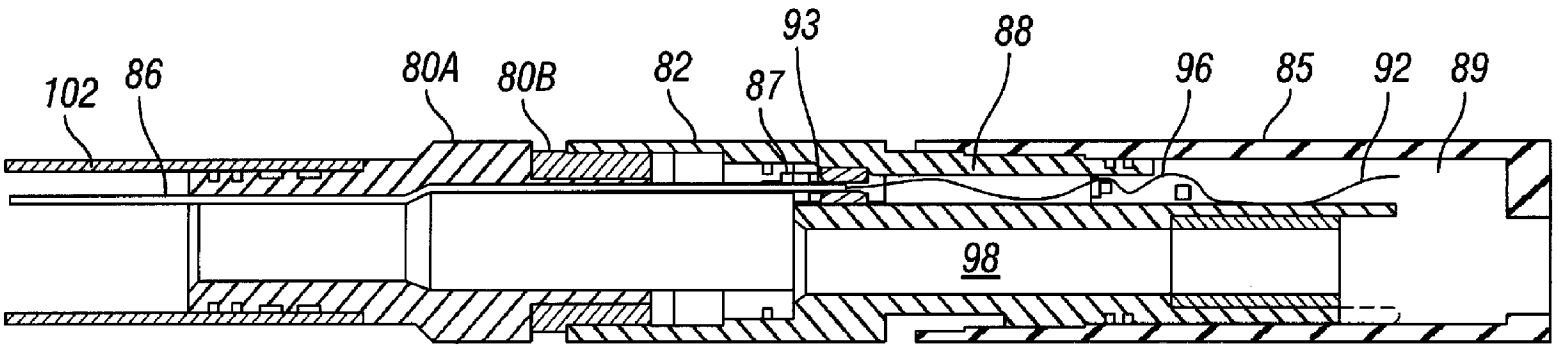

FIGS. 6A and 6B illustrate schematically in side elevation, partially in cross section, a communication system useful in the invention, comprising a bundle of optical fibers inside a metal tube that has been inserted into spoolable tubing. The optical fibers transmit data but no power. Illustrated is a coiled tubing 102 having an optical fiber carrier conduit or tube 86, which may be straight as illustrated. Tube 86 routes one or more optical fibers 92 through coiled tubing 102. Optical fiber termination end 89 is illustrated having four optical fiber terminations, while a second end includes a cartridge seal 93, and a mechanical hold and seal 87, which in this embodiment is a compression style fitting. This series of seals 87, 93, and a bulkhead seal (not illustrated) sealingly connects body 88 to optical fiber carrier 86. Optical fiber 92 may have slack, which may be wound around a fiber optic termination support rod 94 for a portion of its length. A bare fiber optic bulkhead 96 is provided which functions to seal off fiber carrier 86 from well bore and treatment fluids in the event that the coiled tubing head or bottom hole assembly has a failure. A series of connectors 80A, 80B and 82 may be employed as illustrated. Connector 80B may be a threaded collar. Note that a fluid flow path is provided through coiled tubing 102, connectors 80A, 80B, and 82, and through coiled tubing head 82 at 98. Item 85 is a protector and could be replaced with a variety of components.

The communication system may be an electrical cable or a system of optical fibers inside a metal tube such as illustrated in FIGS. 6A and 6B just described. An advantage of using a tube containing optical fibers is that the tube takes up less space inside the coiled tubing and causes less drag. In particular, the tube can be inserted into the coiled tubing before the operation. In the case when the communication system includes an optical fiber, the pressure sensor may also be an optical pressure sensor. A light source such as a laser is included on the coiled tubing reel, which activates the pressure sensor.

A communication device as described in reference to FIGS. 6A and 6B may allow the use of coiled tubing for both flow and reverse flow operations, and may also be used to activate downhole controls and transmit downhole sensor data. The use of the communication system may allow elimination of spoolable connectors and their attendant disadvantages alluded to herein. Instead, the testing measurements and apparatus are conveyed downhole on the coiled tubing, using sensors similar to those of conventional wireline operations. Transmitting downhole power is less of an issue for coiled tubing because hydraulic power is a much more efficient way of moving large amounts of power. This does not mean that hydraulic power needs to be used exclusively for downhole applications on coiled tubing. For example, the apparatus known under the trade designation "DepthLog", from Schlumberger, uses a small battery to switch a hydraulic valve. The position of that valve has a large effect on the surface pressure while pumping, so the combination is almost like a transistor: a small amount of power moves the valve but the valve itself controls a large volume of fluid. Similarly, the apparatus known under the trade designation "CoilFLATE" from Schlumberger uses a battery to move a valve that controls whether or not surface pumped fluid is diverted into an inflatable packer (or a pair of such packers). When the packers are inflated the effect is that the coil to the surface is now in hydraulic communication with a zone of the reservoir and isolated hydraulically from the rest of the reservoir. Large volumes of fluid may then be pumped from the surface into that zone (e.g. to stimulate the rock with acid), or conversely the formation could be allowed to flow into the coil in order to clean out damage or precipitation—in the near wellbore. Batteries useful in the invention may include primary cells, secondary (rechargeable) cells, and fuel cells. Some useful primary cell chemistries include lithium thionyl chloride [$LiSOCl_2$], lithium sulfur dioxide [$LiSO_2$], lithium manganese dioxide [$LiMnO_2$], magnesium manganese dioxide [$MgMnO_2$], lithium iron disulfide [$LiFeS_2$], zinc silver oxide [$ZnAg_2O$], zinc mercury oxide [ZnHgO], zinc-air, [Zn-air], alkaline manganese dioxide [alkaline-$MgO_2$], heavy-duty zinc carbon [Zn-carbon], and mercad, or cadmium silver oxide [CdAgO] batteries. Suitable rechargeable batteries include nickel-cadmium [Ni—Cd], nickel-metal hydride [Ni—MH], lithium ion batteries, and others.

Figure 7:
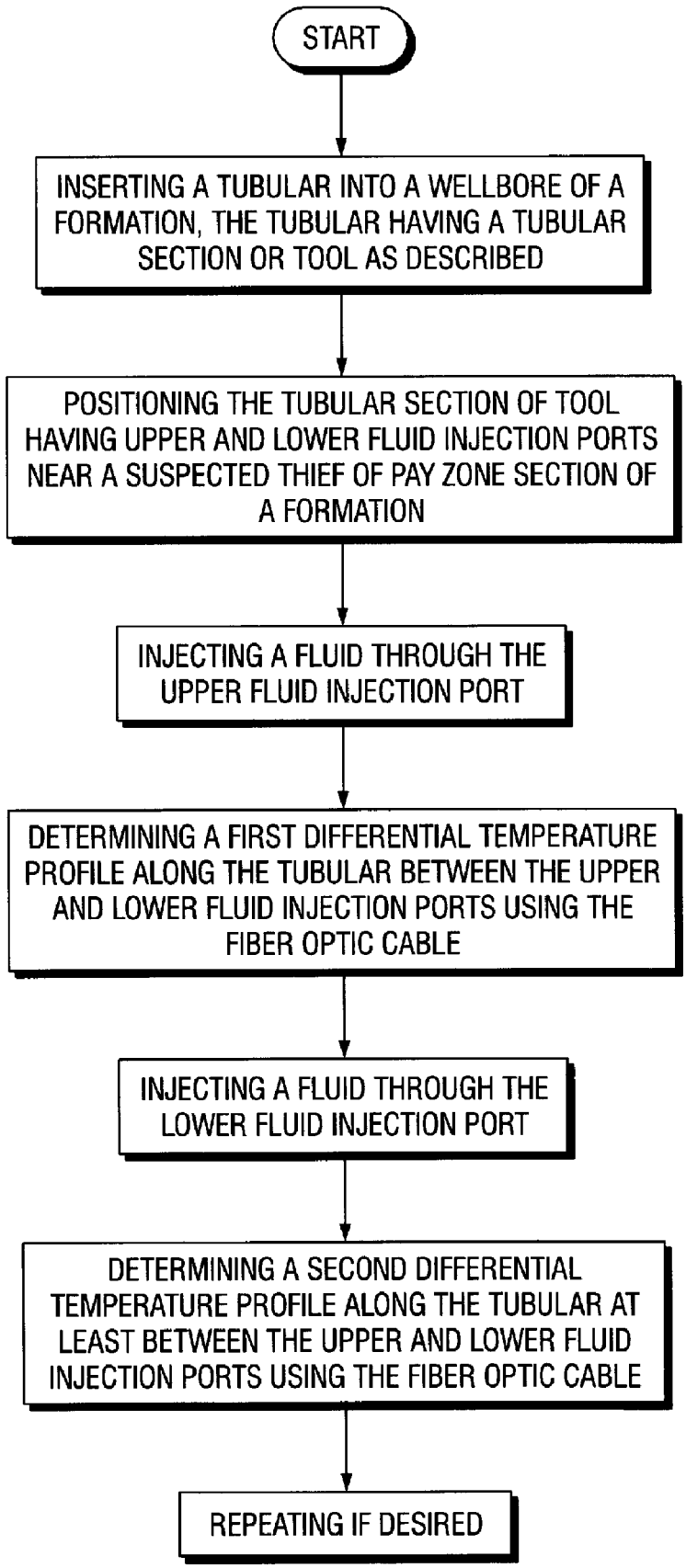
FIG. 7 is a logic flow diagram of certain methods of the invention.

FIG. 7 is a schematic logic diagram of one method of the invention for evaluating one or more thief or producing zones of a wellbore, including the steps of inserting a tubular into a wellbore of a formation, the tubular comprising a tubular section having an upper and a lower fluid injection port, the tubular having a thermally insulated fiber optic cable section positioned inside the tubular extending to the upper fluid injection port, and a non-insulated fiber optic cable section positioned outside of the tubular section and extending at least between the upper and lower fluid injection ports for better thermal contact with formation fluids; positioning the tubular section having upper and lower fluid injection ports near a suspected thief or pay zone section of a formation; injecting a fluid through the upper fluid injection port; determining a first differential temperature profile along the tubular between the upper and lower fluid injection ports using the fiber optic cable; injecting a fluid through the lower fluid injection port; and determining a second differential temperature profile along the tubular at least between the upper and lower fluid injection ports using the fiber optic cable.

Methods of the invention include those wherein the injecting of the fluid may, in the case of the lower fluid injection port, be through the tubular to a bottom hole assembly (BHA) attached to the distal end of the tubular. Optionally, methods of the invention may include determining differential flow, such as by monitoring, programming, modifying, and/or measuring one or more parameters selected from temperature, pressure, rotation of a spinner, measurement of the Hall effect, volume of fluids pumped, fluid flow rates, fluid paths (annulus, tubing or both), acidity (pH), fluid composition (acid, diverter, brine, solvent, abrasive, and the like), conductance, resistance, turbidity, color, viscosity, specific gravity, density, and combinations thereof. Yet other methods of the invention are those wherein one or more parameters are measured at a plurality of points upstream and downstream of a fluid injection point. One advantage of methods and systems of the invention is that fluid volumes and time spent on location performing the fluid treatment/stimulation may be optimized.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. § 112, paragraph 6 unless "means for" is explicitly recited together with an associated function. "Means for" clauses are intended to cover the structures described herein as performing the recited function and not only structural equivalents, but also equivalent structures.

What is claimed is:

1. A method comprising:

(a) inserting a tubular into a wellbore of a formation, the tubular comprising a tubular section having an upper and a lower fluid injection port, the tubular having a thermally insulated fiber optic cable section positioned inside the tubular extending to the upper fluid injection port, and a non-insulated fiber optic cable section positioned outside of the tubular section and extending at least between the upper and lower fluid injection ports for better thermal contact with formation fluids;

(b) positioning the tubular section having the upper and lower fluid injection ports near a suspected thief or pay zone section of a formation;

(c) injecting a fluid through the upper fluid injection port;

(d) determining a first differential temperature profile along the tubular between the upper and lower fluid injection ports using the fiber optic cable;

(e) injecting a fluid through the lower fluid injection port; and (f) determining a second differential temperature profile along the tubular at least between the upper and lower fluid injection ports using the fiber optic cable.

2. The method of claim 1 wherein the injecting of fluid through the upper and lower injection ports is performed by hydraulically selecting a flow rate of the fluid injected in the coiled tubing above or below a threshold flow rate value.

3. The method of claim 2 wherein the injecting of fluid through the upper and lower injection ports is performed by hydraulically actuating the upper and lower fluid injection ports.

4. The method of claim 2 wherein the hydraulic selecting is performed at the surface by an operator.

5. The method of claim 1 comprising increasing depth resolution of the temperature profiles by helically winding the non-thermally insulated optical fiber cable section outside the tubular section.

6. The method of claim 1 further comprising comparing the first differential temperature profile to the second differential temperature profile to determine information about a location of the suspected thief or pay zone.

7. The method of claim 1 comprising thermally insulating the thermally insulated optical fiber section prior to inserting the tubular into the wellbore.

8. The method of claim 7 wherein the thermally insulating of the thermally insulated optical fiber comprises using a double wall flow path within the tubular.

9. The method of claim 1 comprising obtaining the differential temperature profiles in real time.

10. The method of claim 1 comprising identifying a location of an upper portion of a thief zone when the first differential temperature profile indicates a sharp temperature gradient.

11. The method of claim 10 comprising identifying a location of a lower portion of a thief zone when the second differential temperature profile indicate a sharp temperature gradient.

12. The method of claim 11 comprising measuring a point pressure near or at a distal terminus of the tubular.

13. The method of claim 1 comprising communicating with the surface through one or more communication links, the communication link is selected from hard wire, wireless, optical fiber and combinations thereof.

14. A method comprising:

(a) running a tubular into a wellbore of a formation, the tubular comprising a tubular section having an upper and a lower fluid injection port, the tubular having a thermally insulated fiber optic cable section positioned inside the tubular extending to the upper fluid injection port, and a non-insulated fiber optic cable section positioned outside of the tubular section and extending at least from the upper to the lower fluid injection port for better thermal contact with formation fluids;

(b) restricting fluid flow through an annulus between the tubular and the wellbore, at a location between the upper and lower fluid injection ports, during the running;

(c) flowing a fluid through the tubular and out of at least one of the fluid injection ports while running; and (d) measuring a point pressure at one or more positions along the tubular.

15. The method of claim 14 further comprising a step chosen from the group consisting of:

(a) flowing a fluid through the tubular and through the upper fluid injection port, and sensing a sudden pressure increase at the bottom end of the tubular;

(b) flowing a fluid through the tubular and through the upper fluid injection port while sensing point pressure near the bottom of the tubular;

(c) flowing a fluid through the tubular and through the lower fluid injection port while sensing point pressure near the upper fluid injection port; and (d) flowing a fluid through either or both fluid injection ports while sensing point pressure at both the upper and the lower fluid injection ports.

16. A system comprising:

(a) a tubular able to extend from a surface station to a region to be logged in a wellbore, the tubular comprising a main flow passage and upper and lower fluid injection ports separated by a distance of the tubular sufficient to place an annulus flow restriction device between the fluid injection ports;

(b) the tubular having a thermally insulated fiber optic cable section positioned inside the tubular and extending from the surface to the upper fluid injection port, and a non-insulated fiber optic cable section optically connected to the insulated fiber optic cable positioned outside of the tubular section and extending at least between the upper and lower fluid injection ports for better thermal contact with formation fluids; and (c) a annulus flow restriction device positioned between the upper and lower fluid injection ports.

17. The system of claim 16 comprising a plurality of sensors capable of detecting thief zones and/or pay zones, fluid flow out of the tubular, fluid flow below the tubular and up or down the annulus between the tubular and the wellbore in realtime mode having programmable action both downhole and at the surface using one or more algorithms, allowing real time interpretation of downhole data.

18. The system of claim 16 comprising hydraulic means for selecting injection of fluid through the upper and lower injection ports.

19. The system of claim 16 wherein the non-thermally insulated optical fiber cable section is helically would around the tubular section.

20. The system of claim 16 wherein the non-thermally insulated optical fiber cable section is positioned outside the tubular section in double-ended manner.

* * * * *